US006823638B2

(12) United States Patent
Stanchfield

(10) Patent No.: US 6,823,638 B2
(45) Date of Patent: Nov. 30, 2004

(54) HIGH FRICTION JOINT, AND INTERLOCKING JOINTS FOR FORMING A GENERALLY PLANAR SURFACE, AND METHOD OF ASSEMBLING THE SAME

(75) Inventor: Oliver O. Stanchfield, Raleigh, NC (US)

(73) Assignee: Pergo (Europe) AB, Trelleborg (SE)

( * ) Notice: Subject to any disclaimer, the term of this patent is extended or adjusted under 35 U.S.C. 154(b) by 0 days.

(21) Appl. No.: 10/228,065

(22) Filed: Aug. 27, 2002

(65) Prior Publication Data

US 2003/0041545 A1 Mar. 6, 2003

Related U.S. Application Data

(63) Continuation of application No. 09/891,460, filed on Jun. 27, 2001, now abandoned.

(51) Int. Cl.[7] ..... E04C 3/00

(52) U.S. Cl. ..... 52/588.1; 52/586.2; 52/590.2; 52/592.1

(58) Field of Search ..... 52/588.1, 586.2, 52/589.1, 590.2, 586.1, 592.2, 592.1, 592.4; 403/339, 364, 401, DIG. 11

(56) References Cited

U.S. PATENT DOCUMENTS 714,987 A * 12/1902 Wolfe ..... 52/578
753,791 A * 3/1904 Fulghum ..... 144/354

(List continued on next page.)

FOREIGN PATENT DOCUMENTS

| | | |
|---|---|---|
| BE | 1010487 | 10/1998 |
| DE | 1212275 | 3/1966 |
| GB | 812671 | 4/1959 |
| GB | 2256023 | 11/1992 |
| JP | 3169967 | 7/1991 |
| WO | 9627721 | 11/1996 |
| WO | 0006854 | 2/2000 |

OTHER PUBLICATIONS

Knight, Edward H., Knight's American Mechanical Dictionary, vol. III—REA–ZYM, p. 2051, New York (1876).

*Primary Examiner*—Carl D. Friedman
*Assistant Examiner*—Basil Katcheves
(74) *Attorney, Agent, or Firm*—Stevens, Davis, Miller & Mosher, L.L.P.

(57) ABSTRACT

An interlockable panel for forming a generally planar surface. Each panel includes a first surface positioned substantially in a plane and a second surface facing opposite the first surface and substantially parallel to and displaced from the first surface. Each surface has a perimeter defined by edges extending between the first and second surfaces. The edges may include male or female edges. Each male edge includes a tongue that extends outwardly from the male edge and a longitudinally extending void that extends inwardly of the tongue. Each female edge includes a groove having a protrusion position within the groove and extending outwardly from the groove generally parallel to the first surface. An adjacent panel may be linked to a fixed panel such that the tongue engages the groove and the protrusion engages the void. The invention also includes a method for assembling a generally planar surface using interlockable panels such as the above-mentioned. The method generally includes the steps of placing the first surfaces of adjacent panels within a common plane, and manually linking of the male edge of the first panel with the female edge of a second panel, by relatively moving the panels towards each other while maintaining said panels in a common plane.

25 Claims, 5 Drawing Sheets

U.S. PATENT DOCUMENTS

| | | | | | |
|---|---|---|---|---|---|
| 2,732,597 | A | * | 1/1956 | Contratto | 52/590.2 |
| 4,195,462 | A | | 4/1980 | Keller et al. | |
| 4,249,355 | A | * | 2/1981 | Anderson et al. | 52/590.1 |
| 4,426,820 | A | | 1/1984 | Terbrack et al. | |
| 5,295,341 | A | | 3/1994 | Kajiwara | |
| 5,323,584 | A | | 6/1994 | Scarlett | |
| 5,357,728 | A | * | 10/1994 | Duncanson | 52/592.4 |
| 5,425,210 | A | | 6/1995 | Zafir | |
| 5,425,510 | A | * | 6/1995 | Zafir | 52/404.4 |
| 5,502,939 | A | * | 4/1996 | Zadok et al. | 52/309.9 |
| 5,797,237 | A | | 8/1998 | Finkell, Jr. | |
| 5,860,267 | A | | 1/1999 | Pervan | |
| 5,930,967 | A | | 8/1999 | Stoehr et al. | |
| 6,006,486 | A | * | 12/1999 | Moriau et al. | 52/589.1 |
| 6,023,907 | A | | 2/2000 | Pervan | |
| 6,058,659 | A | | 5/2000 | Astrom | |
| 6,065,264 | A | * | 5/2000 | Imler et al. | 52/589.1 |
| 6,101,778 | A | * | 8/2000 | M.ang.rtensson | 52/582.1 |
| 6,216,409 | B1 | * | 4/2001 | Roy et al. | 52/589.1 |
| 6,438,919 | B1 | | 8/2002 | Knauseder | |
| 6,588,166 | B2 | | 7/2003 | Martensson et al. | |
| 6,711,869 | B2 | | 3/2004 | Tychsen | |
| 2002/0046526 | A1 | | 4/2002 | Knauseder | |
| 2002/0148552 | A1 | | 10/2002 | Knauseder | |

* cited by examiner

HIGH FRICTION JOINT, AND INTERLOCKING JOINTS FOR FORMING A GENERALLY PLANAR SURFACE, AND METHOD OF ASSEMBLING THE SAME

CROSS REFERENCE TO RELATED APPLICATIONS

This application is a continuation of U.S. application Ser. No. 09/891,460, filed Jun. 27, 2001, now abandoned.

FIELD OF THE INVENTION

The invention relates to a glueable panel for forming a generally planar surface. The invention is also directed to a method of assembling a planar surface from a plurality of panels. While the uses for a planar surface are numerous, the invention will likely be most commonly used as a floor, especially a floating flooring where the floor is not attached to the subfloor.

BACKGROUND OF THE INVENTION

It is well-known to incorporate floor or wall covering into the design of business or residential uses in order to improve the aesthetics or alter the appearance of rooms. In addition to aesthetic concerns, floor, wall and ceiling coverings may also serve utilitarian purposes as well.

Over the years, many techniques for covering surfaces have been developed. Wallpaper and paneling are but a few examples. A wood surface has been found to be not only aesthetically pleasing, but very durable and low-maintenance. For this reason, many prefer wood covering because of its beauty, low-maintenance, and resistance to wear.

Assembly and installation of floor covering is often an arduous task. For example, unlike carpet or wallpaper, the wood covering required skill, precise measurement and specialized tools in order to install it correctly. Unlike carpet or wallpaper, wood flooring could be neither stretched nor folded in order to accommodate the dimensions of a room. Additionally, wood flooring, especially flooring of tile or planks, required precision fitting in order to prevent the occurrence of gaps or cracks which would affect the physical appearance, as well as the durability and wear-resistance of the covering. This was also true of laminated flooring which has become popular in recent years, including the so-called "glueless" floors which have edges framed with interlocking patterns. Such floors cannot be assembled by pushing the panels together in the same plane, but must be manipulated through a series of angular motions in a particular sequence to assemble the panels into a floor. Therefore, great care and skill are required to insure that the tiles and panels of the surface covering fit neatly and tightly together. This often proved to be an arduous task, as hundreds of tiles or panels were generally required in order to cover a desired surface.

In order to properly install a surface covering of the prior art, one was generally required to carefully install the covering, tile-by-tile, and generally tapping and/or nailing each tile into place, or gluing and adhering the newly-placed tile to the surface to be covered, as well as the previously-placed tile. With the so-called "glueless" floor, the planks required manipulation to assemble them and the floors have been known to fail at the joint since the interlocking patterns at the edges are relatively thin, being machined into these plank edges. Because numerous tiles or panels were often required to be placed, there was the omnipresent danger of one of the tiles or panels becoming unseated during installation, which often required an installer to re-do his work to replace the shifted tile or panel. Still further, temporary clamps or installation straps were required to maintain the panels in position until the glue dried. The present invention addresses these and many other problems of the prior art.

SUMMARY OF THE INVENTION

The invention is directed to a glueable panel for forming a generally planar surface. The panel includes a first surface, lying substantially in a plane, and a second surface facing opposite the first surface and disposed substantially parallel to and displaced from the first surface. A perimeter of the panel is defined by edges extending between the first and second surfaces. The edges may include male edges and/or female edges.

In one embodiment, the panels of the invention are provided with edges that are dimensioned as to increase the friction between assembled panels such the glue may dry without the necessity for external clamps or installation straps. In another embodiment, each male edge includes a tongue extending outwardly from the male edge and a longitudinally extending void extending inwardly of the tongue. Each female edge includes a groove having a protrusion positioned within the groove. The protrusion extends outwardly from the groove generally parallel to the first surface. Adjacent panels may be linked to similar panels such that the tongue engages the groove and the protrusion enters into the void.

Alternatively, the tongue may include a pair of flange-shaped fingers, and the void may extend between the fingers. The void may be formed as a general U-shape. Optionally, the U-shape may be formed with an enlarged bight, and the protrusion may include a bulbous end, such that the bight and the bulbous end are formed to cooperatively engage one another when the protrusion is inserted into the void.

The foregoing are but two ways of increasing the friction or providing an interlocking joint of strength sufficient to permit assembly of adjacent panels without clamping, and without the need for installation straps, or, hammers and tapping blocks. In fact, the panels of the invention can be installed by using hand and arm pressure alone, without the aid of any tools or machines of any kind. Thus, as used herein, the term "manual" means, "without the aid of tools or machines." The friction or interlock need only be sufficient to hold the panels together while the adhesive sets. Panels may be formed where all the edges are identical, for example, all male, or all female edges, or the panels may have differently shaped edges of common gender, e.g two male and two female edges per plank. When more than one male or female edge appears on a single plank, it is not necessary that all single male (or female) edges have the same shape, i.e., the shape of each male edge can differ from other male edges, and each female edge can differ from other female edges. For example, a male edge on a long side of the planking may have a male edge on the short side of the plank which differs in shape. Optionally, adjacent panels are formed to slidingly engage one another along engaged edges. This engagement allows sliding movement but restrains relative movement of the panels transverse to the engaged edges. Such sliding movement facilitates the gluing of the panels, as will be discussed below.

The panels may be formed of any geometric shape. Commonly, the panels will form rectangles, and each male edge may be positioned opposite, or adjacent a female edge. Of course, other planar geometric shapes are also possible, such as triangles, pentagons, hexagons, octagons, or the like.

Preferably, the first (or top) surface of the plank is covered with a laminate. The laminate may be selectively chosen for aesthetics to make any type of pattern, such as a wood grain or stone pattern, for example. Laminates maybe of the high pressure laminate (HPL) or direct laminate (DL) types. Typically, the laminate includes a decorative paper, hard particles such as $Al_2O_3$, to resist abrasion and scratching, and a resin, such as melamine or other thermosetting resin.

Additionally, the panel may also include an adhesive positioned along at least one of the male edges or female edges. The adhesive may be one which is placed on the panel when the panel edges are manufactured or formed at the factory. However, the adhesive may alternately be one placed on the edges immediately before joining the edge to an adjacent panel. In one preferred embodiment, the adhesive is contained within or activated by microballoons that are ruptured upon joining of the plank edges. Alternatively, the adhesive may be activated by use of a solvent, or perhaps the adhesive maybe activated by a chemical reaction that is initiated by friction of the panels contacting one another.

The panels are formed to fit together such that when a first surface of a first panel abuts a first surface of the adjacent panel, there remains no gap therebetween when the panels are in an installed condition.

The invention also includes a method of assembling a planar surface from interlockable panels, such as the ones referred to above. The method includes the steps of providing a plurality of interlockable panels, placing the first surfaces of adjacent panels within a common plane, and manually linking the male edge of a first panel with the female edge of a second panel, or vice-versa by sliding the panels in a common plane. Such assembly can be done using hand and arm pressure alone on a horizontal planar surface. The joints do not require lifting or rotating, or a hammer or tapping block or other tool, that provides leverage to close joint. An adhesive is applied to the joined edges, which allows the installer to select a desired position, then allow the adhesive to cure with the panels in position. The edges are configured to hold the panels in a joined condition until the adhesive cures. Because the edges have sufficient friction or interlock to hold the panels in place while the adhesive cures, no clamping is needed, and no straps are required.

In one preferred embodiment of the method, the linking step may include the step of aligning the male edge of the first panel with the female edge of the second panel in a substantially collinear fashion, then engaging the male edge of the first panel into the female edge of the second panel.

Alternatively, the method includes the step of snap-fitting the male edge into the female edge.

Hand and arm pressure is all that is needed to assemble the friction and interlocking joints of the present invention.

In the embodiments of the invention, the method may also include the step of sliding the panels along the joint edge until a desired position is reached.

Also, the embodiments of the method include the step of applying adhesive to at least one of the male edges or the female edges. The adhesive maybe applied immediately before joining the panels, or it may be activated (such as, by a solvent or by the rupturing of microballoons that contains either solvent, adhesive, or reactive components). Optionally, the adhesive is self-activated so that the adhesive becomes active upon joining adjacent panels, e.g. the male edges contain one part of a two part adhesive and the female edge contains the other part. The joining of the panels causes the adhesive to become activated.

DETAILED DESCRIPTION OF THE PREFERRED EMBODIMENTS

Figure 1:
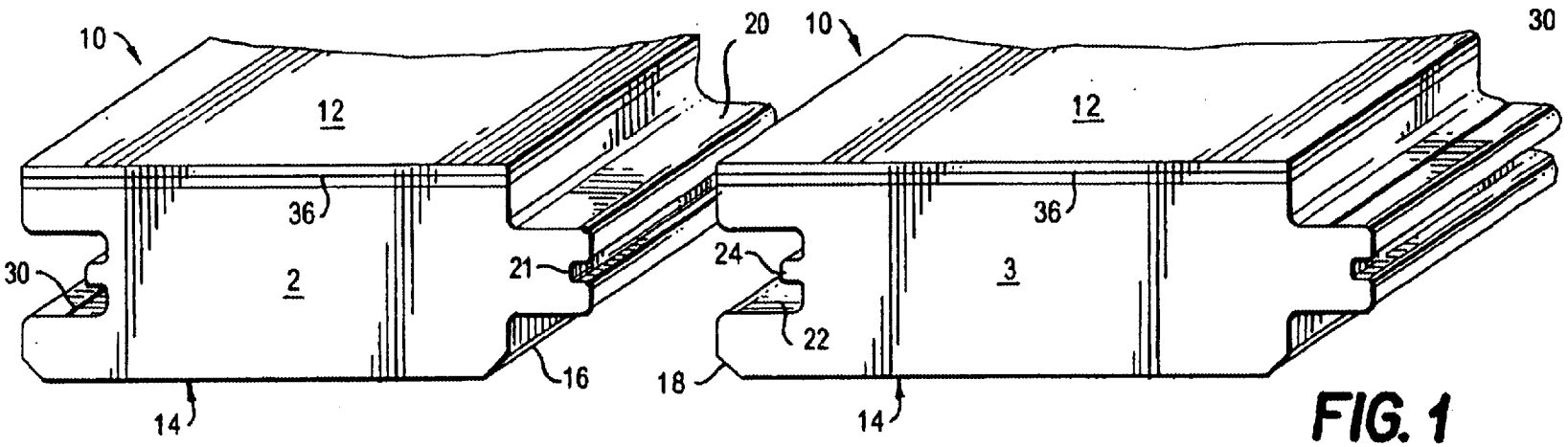
FIG. 1 is a perspective view of a first embodiment, according to the principles of the invention.

FIG. 1 shows a view of a first embodiment of the invention. Each panel 10 includes a first surface 12 and a second surface 14. The perimeter of each panel is defined by edges; the edges may comprise a male edge 16 and a female edge 18. Each male edge 16 includes a tongue 20 having a void 21 extending longitudinally thereon.

Each female edge 18 will include a groove 22 having a longitudinally extending protrusion 24 therein. The protrusion 24 extends in a plane generally parallel to the first surface 12. Alternatively, the protrusion 24 is a continuous rib that extends along the groove 22. The protrusion 24 may also comprise a rib that is interrupted at various places along the groove 22.

A laminate 36 may cover at least one of the first 12 or second 14 surfaces. As shown in FIG. 1, the laminate 36 covers only the first surface 12; however, a laminate 36 may be applied to both surfaces or neither surface 12, 14. Optionally, the panel, including the portions forming the tongue and groove, can be of one piece, e.g., of plastic, metal, or a resin. Alternatively, the laminate 36 may be substituted with a foil, plastic, or other material, such as a wood veneer. The laminate 36 may be bonded to a substrate 2,3, such as compressed cellulosic particles, e.g., strandboard, plywood, or bonded fibers, such as HDF or MDF. The joint portions may be formed by milling the edges, by molding the edges, or by adhering a separate edge to the substrate. Milling is the preferred method.

Figure 2:
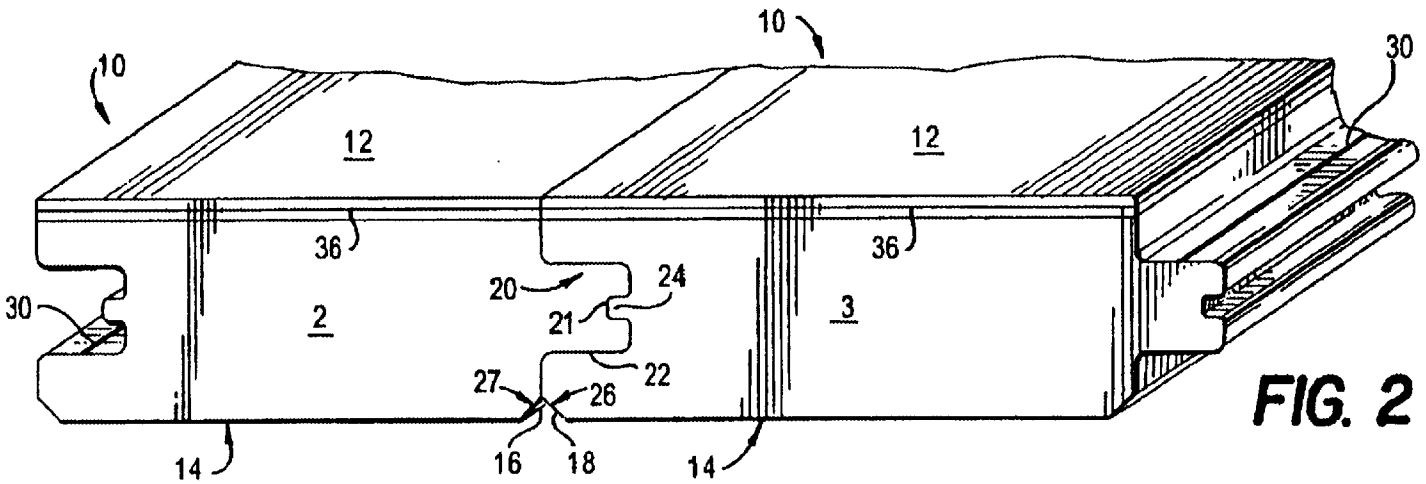
FIG. 2 is a perspective view of the embodiment shown in FIG. 1 depicted in the joined condition.

FIG. 2 depicts the embodiment of FIG. 1 except that the adjacent panels 10 are shown in a joined condition. In the joined condition, the tongue 20 of male edge 16 engages and fits within the groove 22 of female edge 18. Additionally, the protrusion 24 engages and fits within the void 21.

The terms "male edge" and "female edge" are used herein for illustrative purposes only, in order to give a greater understanding of the invention. Therefore, the definition of these terms, as used herein, is not necessarily identical to the respective definitions that may be used in the art.

At least one of the male edges or female edges 16, 18, may include an adhesive 30. FIG. 2 shows the adhesive 30 to be on both a male edge and a female edge. The adhesive 30 may be any of several types of adhesive. For example, a conventional glue may be applied to one of the edges shortly before installation. Alternatively, the edge 16, 18, may be preformed with an adhesive built onto it. Specifically, the edge 16, 18 may include microballoons filled with an adhesive, or an activator for an adhesive. These microballoons may rupture upon installation, thereby enhancing the strength of the joined panels. The adhesive may also be activated by certain wavelengths of light, for example ultraviolet or infrared, acting upon a photoinhibitor contained within the adhesive.

The panels may further include chamfered edges 26 adjacent the intersection of the male edge 16 and second surface 14. Conversely, the panels may also include a chamfered edge 27 adjacent the intersection of the female edge 18 and the second surface 14.

Figure 2A:
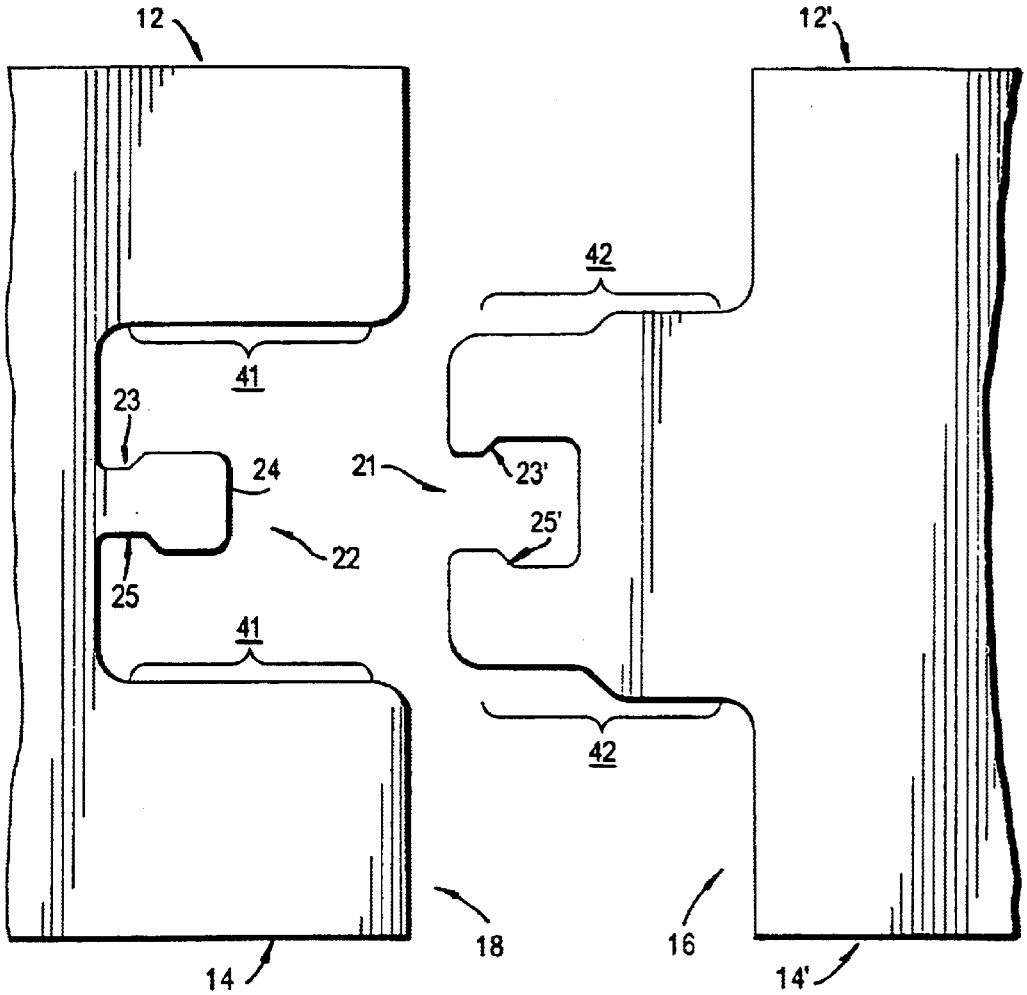
FIG. 2A is a cross-sectional enlarged view of an alternative embodiment of an interlocking joint that juxtaposes the male edge of one panel and the female edge of another.

FIG. 2A shows an enlarged view of a cross-section of the embodiment shown in FIG. 2, allowing depiction of the male and female edges 16,18 in greater detail. The adhesive 30 is generally applied to one of the gluing surfaces 41 on the groove 22, or perhaps to one or more of the gluing surfaces 42 of the tongue 20. The adhesive may also be applied to the protrusion 24 or the recess 21.

Figure 2B:
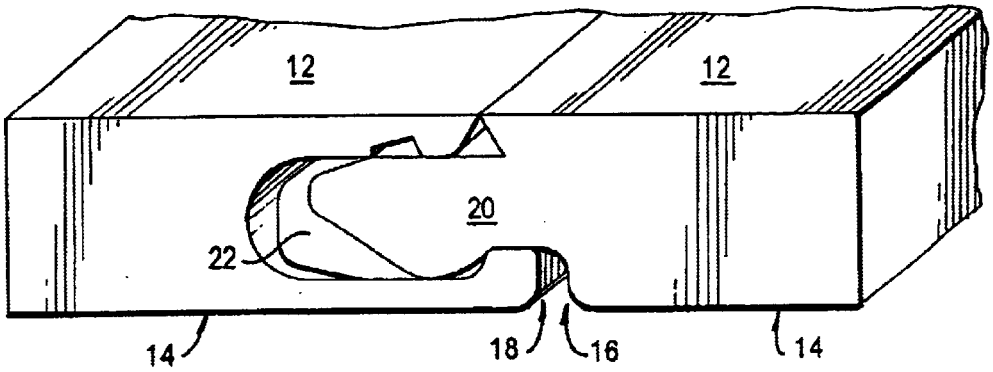
FIG. 2B is a cross-sectioned enlarged view of an alternative embodiment of increased friction joint.
Figure 2C:
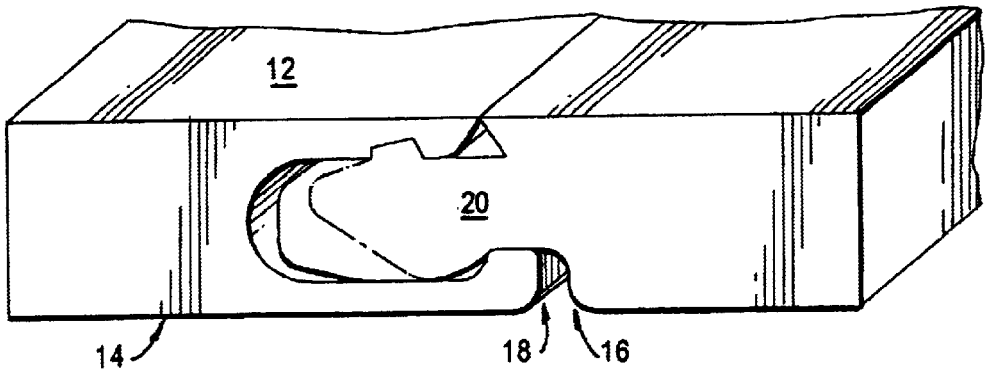
FIG. 2C is a further cross-sectional enlarged view of a still further embodiment of a joint according to the invention.

The view shown in FIG. 2A also shows that the protrusion 24 may have a ridge 23 formed to complement a bulge 23' in the recess 21 of the tongue 20. Additionally, the protrusion 24 may have a ridge 25 formed to complement a bulge 25' on the recess 21 of the tongue 20. Additionally, the female edge may have a wider area 43 on the tongue 20. The glue need not be applied to all surfaces of the joint edges. In FIG. 2A, glue is applied to surfaces 41, and 42 but is not applied to recess 21 nor protrusion 24. FIGS. 2B and 2C illustrate alternative embodiments of the joints of the invention.

Figure 3:
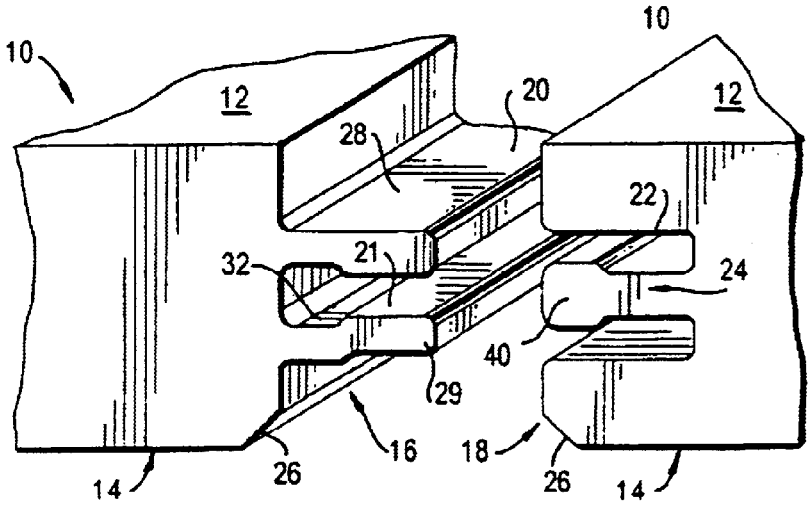
FIG. 3 presents a perspective view of a second embodiment of the invention.

FIG. 3 shows another configuration of the panels 10. The embodiment shown in FIG. 3 differs from the embodiments shown in FIGS. 1 and 2, 2A and 2B; however, elements having similar structure and function have been given identical reference numerals in order to simplify explanation of the invention.

Each panel 10 comprises a first surface 12 and a second surface 14 facing opposite the first surface 12. The perimeter of the panel 10 is defined by edges; the edges may include male edges 16 and female edges 18. Each male edge will include a tongue 20, and each female edge will include a groove 22.

Each tongue 20 will include at least two flange-shaped fingers 28,29 extending outwardly from the male edge 16. A void 21 extends between the fingers 28,29. The void 21 is formed as a general U-shape having an enlarged bight 32. The female edge 18 will include a protrusion 24 extending outwardly from the groove 22. The protrusion 24 extends generally parallel to the first surface 12, and outwardly from the groove. The protrusion 24 may terminate in an enlarged bulbous end 40. As shown, the protrusion 24 is a rib that continuously extends longitudinally along the groove 22. However, the protrusion 24 may also be interrupted along the longitudinal length of the groove 22.

The void 21, protrusion 24, enlarged bight 32 and bulbous end 40 are all cooperatively formed to tightly engage one another when the panels are assembled and interlocked with one another.

When the embodiment shown in FIG. 3 is assembled, the enlarged bulbous end 40 may actually be too large to fit into the void 21. In order to snap-fit the protrusion 24 into the void 21, the flange-shaped fingers 28 of the tongue 20 may outwardly deform to allow the bulbous end 40 to enter the void 21. When the bulbous end 40 reaches the enlarged bight 32, the flange-shaped fingers 28 snap back to their original position, thereby helping retain the protrusion 24 within the void 21. Alternatively, the bulbous end 40 may compress as it is inserted into the void 21, and then return toward its original size as it reaches the enlarged bight 32. The enlarged bight 32 also provides a volume which permits excess glue to be captured within the joint and prevents glue from squeezing to the top surface 12 of the panel, where it may be unsightly and would have to be removed in a separate step.

When the panels 10 are linked with one another, their first surface 12 should abut one another in such a way that no gap exists between the first surfaces 12 of the panels 10.

Figure 4:
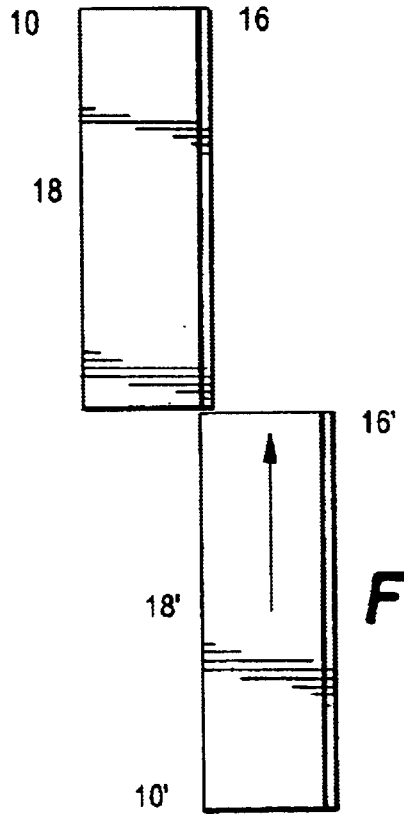
FIG. 4 is a plan view, showing a sliding method of assembly, according to the principles of the invention.

FIG. 4 illustrates a first embodiment of a method of assembly for adjacent panels 10. According to this method, the panels 10, 10' are placed in a common plane (i.e., the plane of the paper) such that a male edge 16 of a first panel 10 is aligned in a substantially collinear fashion with a female edge 18' of a second panel 10'. Then, the second panel 10' slidingly engages the first panel 10 by engaging the male edge 16 into the female edge 18'. The sliding engagement assists in activating the adhesive.

Figure 5:
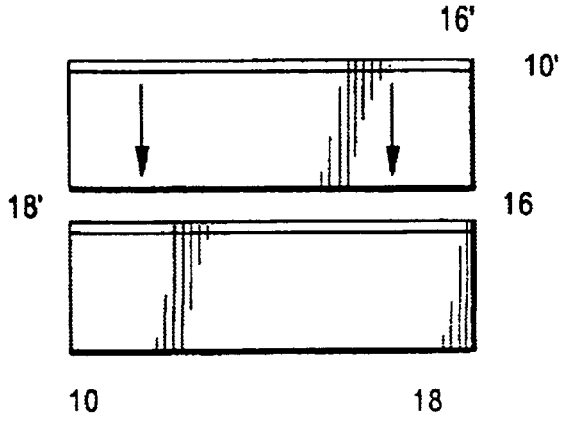
FIG. 5 depicts a plan view showing a snap-fit method of joining adjacent panels, according to the principles of the invention.

FIG. 5 shows an additional method for assembling adjacent panels 10, 10'. In this embodiment, the panels 10, 10' are set in a common plane with the male edge 16 of a first panel facing the female edge 18' of another panel 10'. Then, the respective edges 16, 18' are slid toward one another so the respective edges 16, 18' engage and become interlocked. Generally, an installer will feel a snap-fit when the panels are adjoined using the method depicted in FIG. 5.

In each embodiment of the method (namely, the method shown in FIG. 4 and the method shown in FIG. 5), the panels become engaged such that relative sliding movement along the engaged edges 16, 18', is allowed, but relative movement transverse to the engaged edges 16, 18' is prevented. In all embodiments, the configuration of the edges allows the installer to move the panels before the adhesive cures, and the edges are configured to remain in contact without the use of clamps or installation straps.

Figure 6:
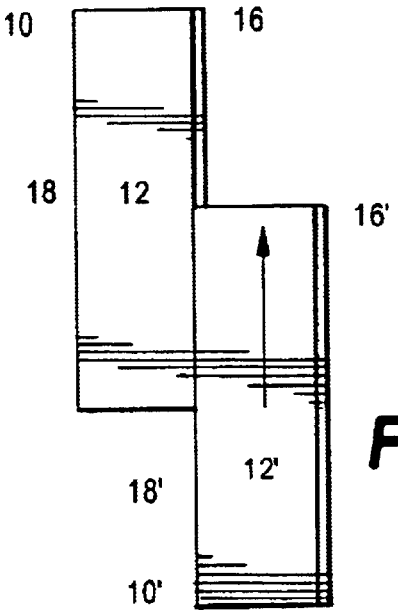
FIG. 6 is a plan view, illustrating the sliding relationship of adjacent panels.

FIG. 6 shows adjacent panels 10 in an already engaged position such that first surfaces 12 abut one another with no gap there between. In this condition, the panels may be slid, such as in the direction shown, until the panel is in a preselected position.

Figure 7:
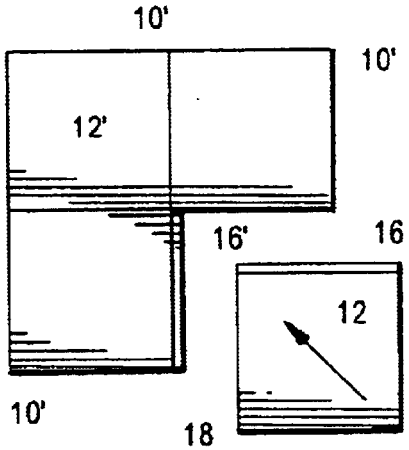
FIG. 7 is a plan view showing an embodiment of the method according to the invention, showing a diagonal direction of installation.

FIG. 7 illustrates yet another method of linking adjacent panels. As shown, a rectangular, e.g., square, panel 10 may be installed with other panels 10' by moving the male edge 16 of a first panel 10 into contact with a female edge 18' of another panel 10' by moving the panel 10 at an angle with respect to the male edge 16. As shown in FIG. 7, the panel 10 may be installed diagonally with respect to the edges 16, 16',18, 18'. The same method of installation may be achieved with rectangular panels, of unequal side dimensions.

Figure 8:
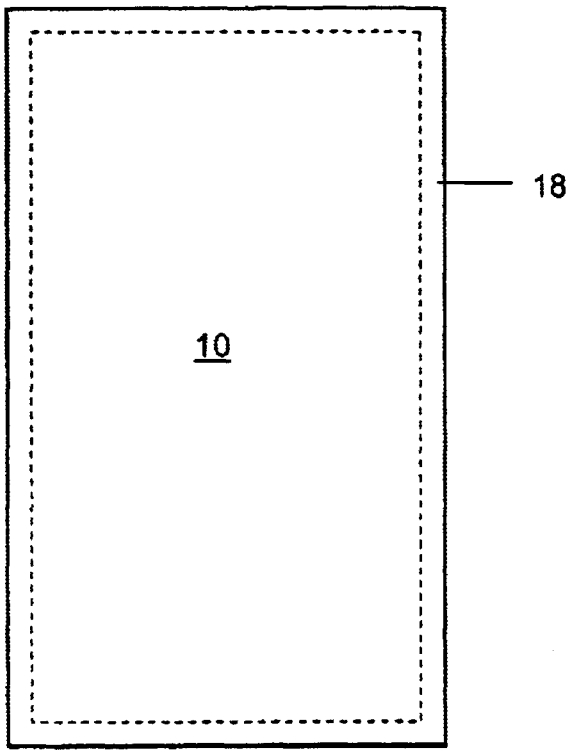
FIG. 8 is a top view of an embodiment of the invention.
Figure 9:
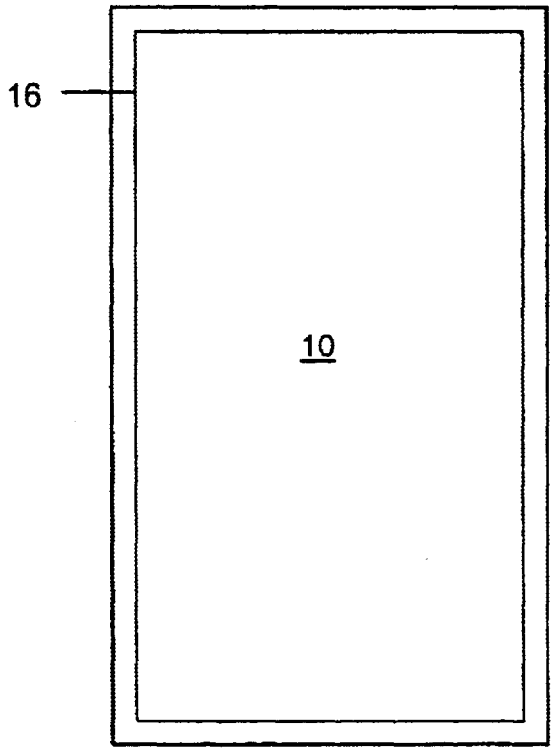
FIG. 9 is a top view of another embodiment of the invention.

FIGS. 8 and 9 show embodiments of the invention, wherein the panel 10 has all female edges 18 and all male edges 16, respectively.

The description herein describes the invention relative to the drawings. The descriptions have been made for illustrative purposes only, and the scope and breadth of the protection is limited in scope only by the appended claims.

I claim:

1. An interlockable panel for forming a generally planar surface, the panel comprising;

a first surface lying substantially in a plane;

a second surface facing opposite the first surface and disposed substantially parallel to and displaced from the first surface;

a perimeter of the panel having edges extending between the first and second surfaces, the edges comprising male edges; wherein each male edge includes a tongue extending outwardly from the male edge and a substantially longitudinally extending void extending inwardly of the tongue, whereby, an adjacent panel may be linked to the interlockable panel such that the tongue engages the groove and the protrusion enters the void, wherein all of the edges are male edges.

2. The panel as in claim 1, wherein the tongue comprises a pair of flange-shaped fingers, and the void extends between the fingers.

3. The panel as in claim 2, wherein, the void is generally U-shaped with an enlarged bight, and the protrusion has a bulbous end, and wherein the bight and bulbous end are cooperatively formed so as to engage one another when the protrusion enters the void.

4. The panel as in claim 3, wherein adjacent panels are formed to slidingly engage one another along engaged edges, yet prevent relative movement of the panels transverse to the engaged edges.

5. The panel as in claim 1, wherein the panel is a rectangle.

6. The panel as in claim 1, further comprising a laminate covering at least one of the first or second surfaces.

7. The panel as in claim 1, further comprising an adhesive positioned along at least one of the edges.

8. A method of assembling a planar surface from interlockable panels, each panel having a first surface lying substantially in a plane and a second surface facing opposite the first surface, and edges comprising at least one of male edges and female edges, the edges defining a perimeter of each panel and connecting the first and second surfaces, the method comprising the steps of:

providing a plurality of interlockable panels, at least one of the panels having a tongue extending outwardly from the male edge and a void extending inwardly of the tongue, and at least one of the panels having a groove extending along the female edge, the groove having at least one protrusion positioned within the groove and configured to engage the tongue by extending into the void;

placing the first surfaces of adjacent panels within a common plane;

manually linking the male edge of a first panel with the female edge of a second panel by relatively moving the panels towards each other in a horizontal plane, the male edge and female edge being configured to retain the linked panels in a linked condition until an adhesive is cured;

selecting a relative position of the first panel with respect to the second panel; providing an adhesive on at least one edge of at least one of the first or second panels; and allowing the adhesive to cure, wherein the linking step includes the step of relatively snap-fitting the male edge into the female edge.

9. The method as in claim 8, wherein the linking step includes the step of aligning the male edge of the first panel with the female edge of the second panel in a substantially collinear fashion, and slidingly engaging the male edge of the first panel into the female edge of the second panel.

10. The method as in claim 8, further comprising the step of manually sliding the second panel into a preselected position relative the first panel.

11. The method of claim 8, wherein the adhesive is activated prior to the step of linking the panels.

12. A method of assembling a planar surface from interlockable panels, each panel having a first surface lying substantially in a plane and a second surface facing opposite the first surface, and edges comprising at least one of male edges and female edges, the edges defining a perimeter of each panel and connecting the first and second surfaces, the method comprising the steps of:

providing a plurality of interlockable panels, at least one of the panels having a tongue extending outwardly from the male edge and a void extending inwardly of the tongue, and at least one of the panels having a groove extending along the female edge, the groove having at least one protrusion positioned within the groove and configured to engage the tongue by extending into the void;

placing the first surfaces of adjacent panels within a common plane;

manually linking the male edge of a first panel with the female edge of a second panel by relatively moving the panels towards each other in a horizontal plane, the male edge and female edge being configured to retain the linked panels in a linked condition until an adhesive is cured;

selecting a relative position of the first panel with respect to the second panel; providing an adhesive on at least one edge of at least one of the first or second panels; and allowing the adhesive to cure, wherein the tongue comprises at least two flange-shaped finger, and a respective void extends between each of the fingers, and the fingers are biased outwardly away from one another as the protrusion enters the void during the linking step.

13. The method as in claim 12, wherein the tongue comprises at least two flange-shaped fingers, and a respective void extends between each of the fingers.

14. The method as in claim 13, wherein each of the voids has a general U-shape with an enlarged bight.

15. The method as in claim 14, wherein the protrusion includes a bulbous end, so that the bulbous end moves within the bight when the second panel slides relative the first panel.

16. The method as in claim 12, wherein the step of providing adhesive includes depositing a bead of glue on at least one of a male edge or female edge.

17. The method as in claim 12, wherein said manual linking is accomplished without the use of tools.

18. The method of claim 12, wherein the adhesive is activated prior to the step of linking the panels.

19. The method as in claim 12, wherein the linking step includes the step of aligning the male edge of the first panel with the female edge of the second panel in a substantially collinear fashion, and slidingly engaging the male edge of the first panel into the female edge of the second panel.

20. The method as in claim 12, wherein the tongue comprises at least two flange-shaped fingers, and a respective void extends between each of the fingers.

21. An interlockable panel for forming a generally planar surface, the panel comprising:

a first surface lying substantially in a plane;

a second surface facing opposite the first surface and disposed substantially parallel to and displaced from the first surface;

a perimeter of the panel having edges extending between the first and second surfaces, the edges comprising female edges; wherein each female edge includes a groove having a protrusion positioned within the groove and extending outwardly from the groove generally parallel to the first surface, whereby, an adjacent panel may be linked to the interlockable panel such that the tongue engages the groove and the protrusion enters the void, wherein all of the edges are female edges.

22. The panel as in claim 21, further comprising an adhesive positioned along at least one of the edges.

23. The panel as in claim 22, wherein the adhesive is a built-in adhesive.

24. The panel as in claim 21, wherein the panel is a rectangle.

25. The panel as in claim 21, further comprising a laminate covering at least one of the first or second surfaces.

* * * * *